United States Patent [19]

Sumikawa et al.

[11] Patent Number: 4,830,590

[45] Date of Patent: May 16, 1989

[54] SLIDING-VANE ROTARY COMPRESSOR

[75] Inventors: Seiji Sumikawa; Hidehiko Takayama; Yoshio Suzuki; Mitsuya Ono, all of Konan, Japan

[73] Assignee: Diesel Kiki Co., Ltd., Tokyo, Japan

[21] Appl. No.: 176,178

[22] Filed: Mar. 31, 1988

[30] Foreign Application Priority Data

Apr. 3, 1987 [JP] Japan ..... 62-50784

[51] Int. Cl.[4] ..... F04C 18/18; F04C 29/02

[52] U.S. Cl. ..... 418/96; 418/DIG. 1

[58] Field of Search ..... 418/96, DIG. 1, 97, 418/98, 99, 100; 184/6.16, 103.1

[56] References Cited

U.S. PATENT DOCUMENTS

| | | | |
|---|---|---|---|
| 1,972,962 | 9/1934 | Weber | 184/103.1 |
| 1,972,974 | 9/1934 | Becker, Jr. | 184/6.16 |
| 3,833,318 | 9/1974 | Nakayama et al. | 418/DIG. 1 |
| 3,988,080 | 10/1976 | Takada | 418/98 |
| 4,340,339 | 7/1982 | Hiraga et al. | 418/98 |
| 4,484,868 | 11/1984 | Shibuya et al. | 418/100 |
| 4,571,164 | 2/1986 | Shibuya et al. | 418/98 |
| 4,632,650 | 12/1986 | Frieden et al. | 418/96 |

*Primary Examiner*—Carlton R. Croyle
*Assistant Examiner*—Timothy S. Thorpe
*Attorney, Agent, or Firm*—Wenderoth, Lind & Ponack

[57] ABSTRACT

A sliding-vane rotary compressor of the type having a cylinder, a rotor rotatably disposed therein and carrying thereon a plurality of vanes, a pair of side blocks attached to opposite ends of the cylinder, and a pair of heads attached to the side blocks, respectively, the improvement which comprises a partition wall separating an oil sump from a low pressure chamber which is defined by and between one of the side block and the head attached thereto, and at least two connecting passages interconnecting the oil sump and a high pressure chamber which is defined by and between the other side block and the head attached thereto.

2 Claims, 2 Drawing Sheets

SLIDING-VANE ROTARY COMPRESSOR

BACKGROUND OF THE INVENTION

1. Field of the Invention

The present invention relates to a sliding-vane rotary compressor suitable for use in an automobile air conditioning system, for example.

2. Description of the Related Art

There has been a growing demand for a compact sliding-vane rotary compressor. With this demand in view, the present applicant has proposed one such compact compressor as disclosed in Japanese Patent Application No. 62-241019.

The disclosed compressor, as reillustrated here in FIG. 3 of the accompanying drawings, includes a cylinder 1, two side blocks *7a, 7b* secured to opposite ends of the cylinder 1, and two heads 11*a*, 11*b* directly connected to the side blocks *7a, 7b*. With this construction, the compressor, as distinct from other conventional ones, has no structural component corresponding to a shell. A rotor 2 fixedly mounted on a drive shaft 4 is rotatably received in the cylinder 1 so as to define therebetween two operating compartments *3a, 3b*. The rotor 2 carries thereon a plurality of radially movable vanes so that the cylinder 1, the rotor 2 and the vanes define therebetween a plurality of compression chambers which vary in volume with each revolution of the rotor 2. One of the side blocks *7a* and the corresponding head 11*a* define therebetween a low pressure chamber 17 through which a working gas is introduced into the operating compartments *3a, 3b*. The gas after having been compressed in the compression chambers is then fed into a high pressure chamber 18 which is defined by and between the other side block *7b* and the mating head 11*b*. The gas, as its flows through the high pressure chamber 18 toward a discharge port 16, is separated from an lubricating oil. The oil thus separated is held in a lower portion of the high pressure chamber 18 and continuously fed on occasion to sliding surfaces of the rotor 2, the vanes and other movable parts.

In the compressor of the foregoing construction, the high pressure chamber must be large enough to hold a great amount of oil for not causing seizing of the sliding surfaces. Due to this large high pressure chamber, a substantial reduction in axial dimension or size of the compressor is difficult to obtain.

SUMMARY OF THE INVENTION

With the foregoing difficulty in view, it is an object of the present invention to provide a sliding-vane rotary compressor which is compacted in size in its axial direction.

Another object of the present invention is to provide a sliding-vane rotary compressor having structural features which are effective to limit the oil leake occurring when the compressed gas is discharged from the compressor.

According to the present invention, the foregoing and other objects are attained by a sliding-vane rotary compressor comprising:

a cylinder and a rotor rotatably mounted therein and defining therebetween an operating compartment, the rotor carrying thereon a plurality of radially movable vanes, there being defined between the cylinder, the rotor and the vanes a plurality of compression chambers which vary in volume with each revolution of the rotor;

a pair of side blocks attached to opposite ends of the cylinder;

a pair of heads attached to the side blocks, respectively;

one of the side blocks and one of the heads which is attached to said one side block jointly defining therebetween a low pressure chamber communicating with an intake port of the compressor;

the other side block and the other head attached thereto define therebetween a high pressure chamber communicating with a discharge port of the compressor;

said one head having a partition wall disposed in said low pressure chamber and extending between said one head and said one side block so as to define therebetween an oil sump disposed at a lower portion of said low pressure chamber; and the side blocks and the cylinder having at least two connecting passages extending therethrough between the oil sump and the high pressure chamber, at least one of the connecting passages having one end disposed at an upper end of the oil sump.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

A certain preferred embodiment of the present invention will be described below in greater detail with reference to the drawings.

Figure 1:
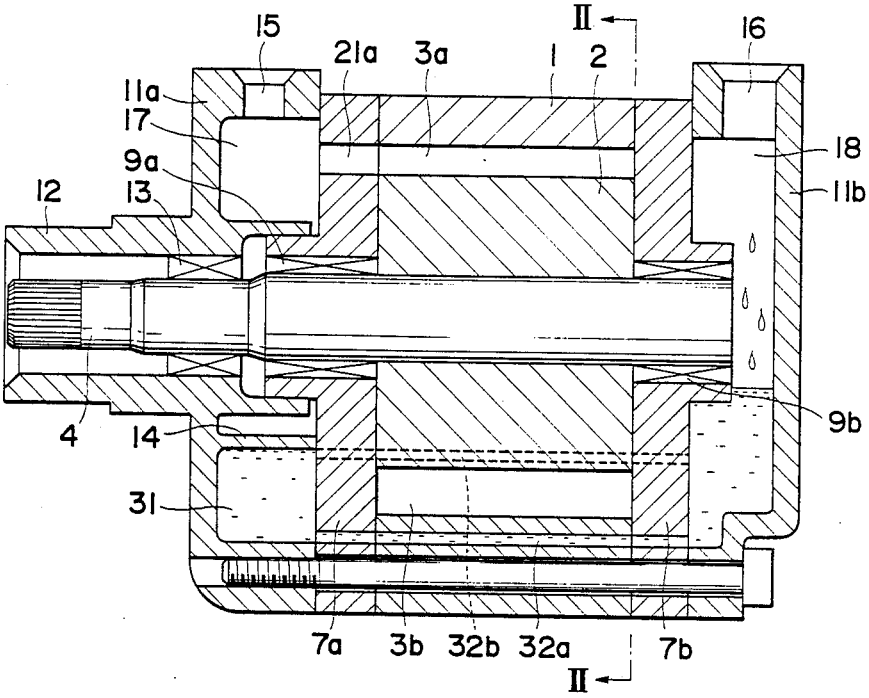
FIG. 1 is a longitudinal cross-sectional view of a sliding-vane rotary compressor according to the present invention.
Figure 2:
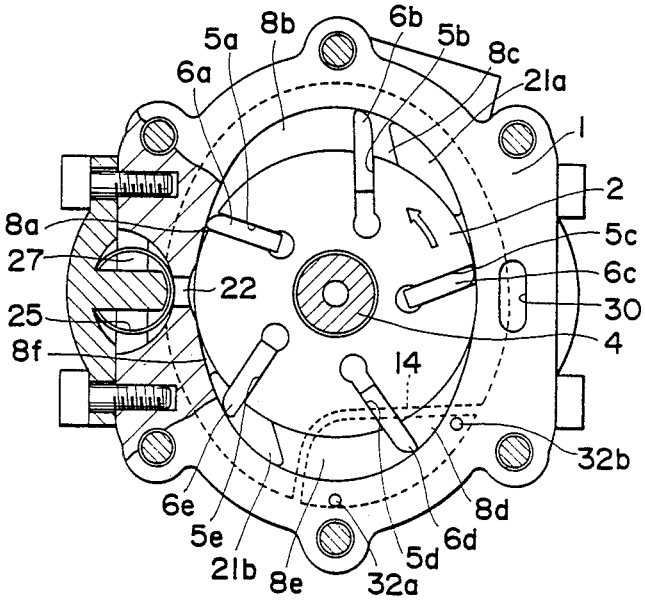
FIG. 2 is a cross-sectional view taken along line II—II of FIG. 1.
Figure 3:
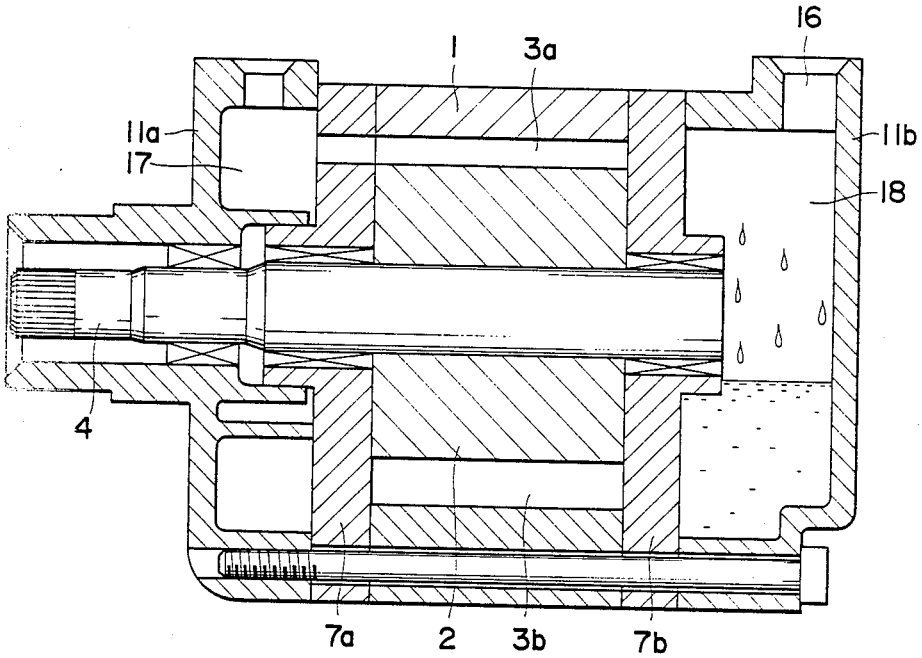
FIG. 3 PRIOR ART
FIG. 3 is a view similar to FIG. 1, but showing a conventional sliding-vane rotary compressor.

FIGS. 1 and 2 show a sliding-vane rotary compressor embodying the present invention. The compressor includes a cylinder 1 and a rotor 2 rotatably disposed in a substantially elliptical bore in the cylinder 1. The rotor 2 is sealingly engageable with the inner wall of the cylinder 1 along a minor axis of the elliptical bore so that there are defined between the rotor 2 and the cylinder 1 two operating compartments *3a, 3b* disposed in diametrically opposite symmetric relation to one another.

The rotor 2 is fixedly mounted on a drive shaft 4 in concentric relation thereto and includes a plurality (five in the illustrated embodiment) of approximately radial slots *5a–5e* in which vanes *6a–6e* are slidably inserted, respectively.

A front side block *7a* and a rear side block *7b* are firmly connected to opposite ends of the cylinder 1 to close the same in such a manner that the rotor 2 and the vanes *6a–6e* are held in sliding contact with inner walls of the front and rear side blocks *7a, 7b*. With this arrangement, there are defined between the cylinder 1, the rotor 2 and the vanes *6a–6e* a total of six compression chambers *8a–8f*.

The drive shaft 4 is rotatably supported by the side blocks *7a, 7b* via a pair of radial bearings *9a, 9b*.

A front head 11*a* and a rear head 11*b* are firmly connected to the front side block 7*a* and the rear side block 7*b*, respectively. The front head 11*a* includes a central hollow cylindrical hub 12 for receiving therein an electromagnetic clutch (not shown). The drive shaft 4 has an end portion extending in the hub 12 for being releasably coupled with an engine crankshaft (not shown) via the clutch to receive the engine torque. A mechanical seal 13 is disposed between the end portion of the drive shaft 4 and the front head 11*a*.

The cylinder 1, the side blocks 7*a*, 7*b* and the heads 11*a*, 11*b* have respective flat end surfaces held in flatwise sealing contact with each other to provide hermetic seals between the cylinder 1 and the side blocks 7*a*, 7*b* and between the side blocks 7*a*, 7*b* and the heads 11*a*, 11*b*. The front head 11*a* has defined in its upper portion an intake port 15 while the rear head 11*b* has defined in its upper portion a discharge port 16. The intake port 15 is held in fluid communication with a low pressure chamber 17 which is defined jointly by and between the front side block 7*a* and the front head 11*a*. The discharge port 16 is held in fluid communication with a high pressure chamber 18 which is defined jointly by and between the rear side block 7*b* and the rear head 11*b*. The front head 11*a* has a partition wall 14 formed integrally therewith and projecting therefrom into engagement with the front side block 7*a*, the partition wall 14 being disposed in a lower portion of the low pressure chamber 17. As shown in FIG. 2, the partition wall 14 is downwardly bent and includes a horizontal portion and a substantially vertical portion which are umsymmetric with each other with respect to the central axis of the drive shaft 4. The shape and position of the partition wall 14 are determined by the shape and position of a pair of diametrically opposite intake holes 21*a*, 21*b* defined in the front side block 7*a*. The intake holes 21*a*, 21*b* communicate the low pressure chamber 17 with the operating compartments 3*a*, 3*b* when the compression chambers 8*a*–8*f* increase in volume during the suction stroke of the compressor. On the other hand, when the compression chambers 8*a*–8*f* decrease in volume during the discharge stroke, the operating compartments 3*a*, 3*b* are brought to fluid communication with the high pressure chamber 18 successively through a pair of diametrically opposite discharge holes 22 (only one shown in FIG. 2), valve receiving chambers 27 and discharge connecting holes 30. The discharge holes 22 extend along the minor axis of the elliptical bore in the cylinder 1. The valve receiving chambers 27 are contiguous to the corresponding discharge holes 22 and house a pair of discharge valves 25 (only one shown in FIG. 2), respectively. The discharge connecting holes 30 extend between the valve receiving chambers 27 and the high pressure chamber 18. The front side block 7*a*, the front head 11*a* and the partition wall 14 jointly define therebetween an oil sump 31 disposed at a lower portion of the low pressure chamber 17. The oil sump 31 is connected with the high pressure chamber 18 through a pair of parallel spaced connecting passages 32*a*, 32*b* which extend continuously through the front side block 7*a*, the cylinder 1 and the rear side block 7*b*. The connecting passages 32*a*, 32*b* extend parallel to the axis of the drive shaft 4 and one of the connecting passages 32*a* has one end connected to a lower end of the oil sump 31. The other connecting passage 32*b* has one end connected with an upper end of the oil sump 31. The connecting passages 32*a*, 32*b* have a diameter small enough to prevent the oil in the oil sump 31 from raising and lowering in immediate response to a sudden change in level of the oil which is held in the high pressure chamber 18.

With this construction, when the drive shaft 4 is driven to rotate the rotor 2 in one direction, the vanes 6*a*–6*e* slide along the inner wall of the cylinder 1 to cause the compression chambers 8*a*–8*f* to successively increase and decrease in size with each revolution of the rotor 2. As the compression chambers 8*a*–8*f* increase in size or volume during the intake or suction stroke, they are brought to fluid communication with the low pressure chamber 17 through the intake holes 21*a*, 21*b*, whereupon a gas which has been introduced from the intake port 15 into the low pressure chamber 17 is drawn into the compression chambers 8*a*–8*f* through the intake holes 21*a*, 21*b*. Then the compression chambers 8*a*–8*f* gradually decrease in size and when succeeding vanes 6*a*–6*e* move past the intake holes 21*a*, 21*b*, the gas is trapped in the compression chambers 8*a*–8*f*. Thus, the compression is commenced. A further movement of the rotor 2 causes the preceding vanes 6*a*–6*e* to move past the discharge holes 22 whereupon the compression chambers 8*a*–8*f* communicate with the discharge holes 22 and then the discharge valves 25 are forced by the pressure in the compression chambers 8*a*–8*f* to retract away from the discharge holes 22 in the valve receiving chambers 27. Then the gas flows through the discharge connecting holes 30 into the high pressure chamber 18 in which it is removed from a lubricating oil entrained therein. Finally, the gas is discharged from the discharge port 16 to the outside of the compressor.

The oil having been separated from the gas is then held in a lower portion of the high pressure chamber 18 and also in the oil sump 31 connected to the high pressure chamber 18 through the connecting passages 32*a*, 32*b*. When the oil level in the high pressure chamber 18 remains below the upper connecting passages 32*b*, an increase in level (i.e. quantity) of the oil in the high pressure chamber 18 causes the oil to flow through the lower connecting passage 32*a* into the oil sump 31 until the oil sump 31 has the same level to the high pressure chamber 18. During that time, the gas remaining in the oil sump 31 is expelled through the upper connecting passage 32*b* into the high pressure chamber 18. Consequently, when the oil level exceeds the upper end of the connecting passage 32*b*, the oil sump 31 is filled solely with the oil and is free from gas.

It is likely to occur that the oil in the high pressure chamber 18 is suddenly withdrawn together with the gas when the operation of the compressor is started. In this instance, if the connecting passages 32*a*, 32*b* have a large diameter, the oil in the oil sump 31 would also be withdrawn, resulting in a shortage of oil in the compressor as a whole. According to the present invention, such oil shortage can be avoided as the diameters of the connecting passages 32*a*, 32*b* are small enough to prevent the oil in the oil sump 31 from raising and lowering in immediate response to a sudden change in oil level in the high pressure chamber 18, thereby insuring that an adequate amount of oil is alway stored in the oil sump 31.

In the illustrated embodiment, the number of the connecting passages 32*a*, 32*b* are two, however, three or more connecting passages are available provided that at least one of the connecting passages is connected with the upper end of the oil sump 31. The front and rear sides of the compressor may be reversed, in which instance a discharge port and a high pressure chamber connected thereto are provided in the front side while an oil sump, a low pressure chamber and an intake port connected thereto are provided in the rear side.

Obviously, various modifications and variations of the present invention are possible in the light of the above teaching. It is therefore to be understood that within the scope of the appended claims the invention may be practiced otherwise than as specifically described.

What is claimed is:

1. A sliding-vane rotary compressor comprising:

(a) a cylinder and a rotor rotatably mounted therein and defining therebetween an operating compartment, said rotor carrying thereon a plurality of radially movable vanes, there being defined between said cylinder, said rotor and said vanes a plurality of compression chambers which vary in volume with each revolution of said rotor;

(b) a pair of side blocks attached to opposite ends of said cylinder;

(c) a pair of heads attached to said side blocks, respectively;

(d) one of said side blocks and one of said heads which is attached to said one side block jointly defining therebetween a low pressure chamber communicating with an intake port of said compressor;

(e) the other side block and the other head attached thereto define therebetween a high pressure chamber communicating with a discharge port of said compressor;

(f) said one head having a partition wall disposed in said low pressure chamber and extending between said one head and said one side block so as to define an oil sump at the bottom of said low pressure chamber; and (g) said side blocks and said cylinder having at least two connecting passages extending therethrough between said oil sump and said high pressure chamber, at least one of said connecting passages having one end disposed at an upper end of said oil sump.

2. A sliding-vane rotary compressor according to claim 1, said connecting passages having a diameter such that the oil in said oil sump is prevented from raising and lowering in immediate response to a sudden oil level change in said high pressure chamber.

* * * * *